United States Patent [19]

Anderson et al.

[11] Patent Number: 4,601,812

[45] Date of Patent: Jul. 22, 1986

[54] OIL SHALE RETORTING PROCESS

[75] Inventors: Ardis L. Anderson; James R. McConaghy, Jr., both of Ponca City, Okla.

[73] Assignee: Conoco Inc., Ponca City, Okla.

[21] Appl. No.: 689,108

[22] Filed: Jan. 7, 1985

[51] Int. Cl.[4] ..... C10G 1/00; C10B 53/06

[52] U.S. Cl. ..... 208/410; 201/32; 208/417; 208/426; 208/427

[58] Field of Search ..... 208/11 R; 201/8, 34, 201/42, 10, 12

[56] References Cited

U.S. PATENT DOCUMENTS

| | | | |
|---|---|---|---|
| 3,044,859 | 7/1962 | Parker | 208/11 R |
| 3,440,162 | 4/1969 | Lawson, Jr. | 208/11 R |
| 3,499,834 | 3/1970 | Goins | 208/11 R |
| 3,501,394 | 3/1970 | Lyons | 208/11 R |
| 3,573,197 | 3/1971 | Gessner | 208/11 R |
| 3,784,462 | 1/1974 | Frick | 208/11 R |
| 3,976,558 | 8/1976 | Hall | 201/12 |
| 4,087,347 | 5/1978 | Langlois et al. | 23/209.4 |
| 4,105,502 | 8/1978 | Choi | 208/11 R |
| 4,263,124 | 4/1981 | Wickstrom et al. | 208/11 R X |
| 4,314,899 | 2/1982 | Styring, Jr. | 208/11 R |
| 4,336,128 | 6/1982 | Tamm | 208/11 R |
| 4,388,173 | 6/1983 | Escher et al. | 201/31 X |
| 4,421,629 | 12/1983 | York et al. | 208/11 R X |
| 4,424,021 | 1/1984 | Merrill, Jr. | 208/11 R X |

*Primary Examiner*—Andrew H. Metz
*Assistant Examiner*—Glenn A. Caldarola
*Attorney, Agent, or Firm*—Richard W. Collins

[57] ABSTRACT

A oil shale retorting process in which oil shale particles are separated into fines and large particles. The large particles are preheated and combined with hot spent shale from a combustor and introduced into a retorting vessel. The fines are introduced into the disengaging section of the retorting vessel. Retort vapors are processed to produce an upgraded syncrude. The portion of the retort vessel where the oil shale and spent shale are introduced has a smaller diameter than the retorting section.

3 Claims, 1 Drawing Figure

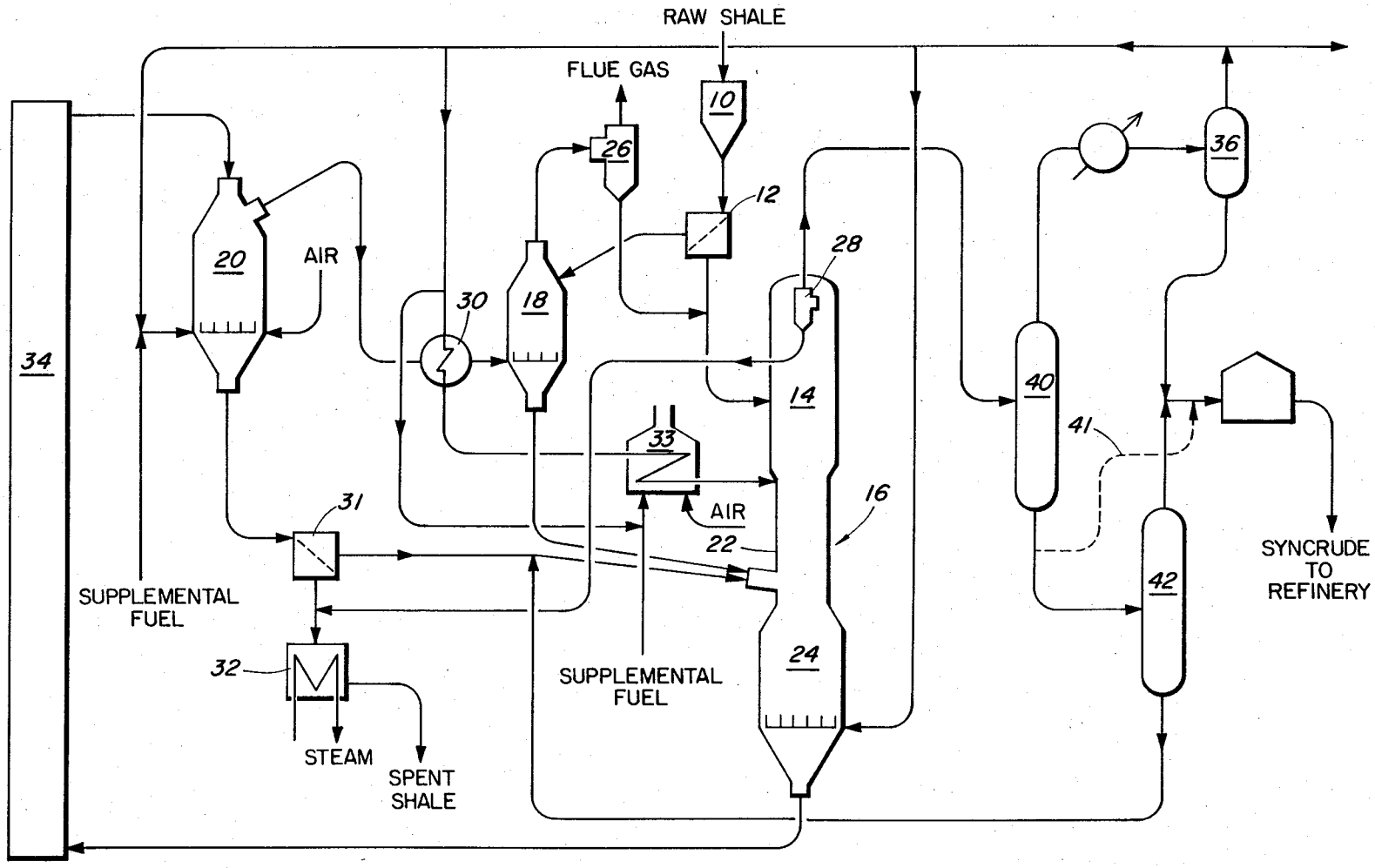
SYNCRUDE TO REFINERY
36
42
41
40
16
28
14
24
RAW SHALE
10
12
AIR
22
33
SUPPLEMENTAL FUEL
FLUE GAS
26
18
30
SPENT SHALE
31
STEAM
AIR
20
32
SUPPLEMENTAL FUEL
34

OIL SHALE RETORTING PROCESS

BACKGROUND OF THE INVENTION

1. Field of the Invention

This invention relates to oil shale retorting, and more particularly to an improved retorting process that is energy efficient and which produces an upgraded syncrude product.

2. The Prior Art

Above-ground shale retorts can be grouped into three categories.

In the first category, the retorts are heated by a flow of internal combustion gases through the bed. In this type process, thermal efficiencies are high because energy is recovered from the retorted shale by combusting the carbonaceous residue from the retorting step. However, shale oil recoveries are rather low, heat transfer is slower than for a solid-solid system, and the gas produced is of low heating value.

In the second category, the oil shale is contacted with flowing gases that have been heated outside the retort. Thermal efficiencies are rather low for this type process because energy is not recovered from the residual carbon. However, oil recovery is quite high, and a high heating value gas is produced.

In the third category, retort heat is provided by solid-solid contact in which oil shale is contacted with hot spent shale or other solid heat carrier from a combustor or other type of solids heater. High oil recoveries result, and a high heating value gas is produced. However, the oil shale feed must be contacted with large amounts of hot spent shale to provide adequate retort heat, and a large amount of fines are carried over with the retort vapors presenting liquid cleanup problems.

Many variations of oil shale retorting processes are described in the prior art. U.S. Pat. Nos. 3,044,859; 3,440,162; 3,573,197; 3,784,462; and 4,087,347 are representative of this prior art. These patents describe variations of solid-solid heat exchange processes including use of bucket elevators to move hot char (U.S. Pat. No. 3,573, 197) and return of heavy oil from a distillation column to the retorting zone (U.S. Pat. No. 3,440,162).

SUMMARY OF THE INVENTION

According to the present invention, an oil shale retorting process is provided which is simple, energy efficient, and which produces an upgraded syncrude. This process utilizes a large particle size feed, such that a minimum of fines is generated. Solid-solid heating provides rapid and efficient heat transfer. Solids movement, other than by gravity, is minimized, and an essentially asphaltene free syncrude having good rheological properties can be produced. A retort having a reduced diameter feed inlet section between an upper disengaging section and a lower retorting section is utilized.

BRIEF DESCRIPTION OF THE DRAWING

The FIGURE is a schematic representation of the retorting process according to the invention.

DESCRIPTION OF THE PREFERRED EMBODIMENTS

A feature of this invention is that a relatively large raw oil shale particle size can be utilized, such that energy costs for crushing oil shale are reduced, and the amount of fines generated is substantially reduced. Particle sizes for oil shale feed of up to 5 cm and more in maximum particle dimension can be utilized, and preferably at least about 75 percent by weight of the oil shale feed is constituted of particles which are retained on a No. 4 mesh U.S. Sieve Series sieve. Most preferably more than 90 percent by weight of the feed is in this size range.

Referring to the Drawing, crushed raw oil shale feed is fed into feed hopper 10. The feed is then screened in screen 12, preferably a No. 4 mesh screen, to remove the small amount of fines in the feed. The fines are then fed directly into the disengaging section 14 of retort vessel 16. The larger feed particles from screen 12 are fed to the top of preheater 18 where they are preheated by countercurrent flow of hot gas from combustor 20. The preheated feed is then combined with hot recycle shale and passed to reduced diameter section 22 of retort vessel 16. The reduced diameter section 22 minimizes coning of the feed in retorting section 24 of vessel 16. The disengaging section 14 may be of larger, smaller or the same diameter as the vessel diameter at the fresh shale feed point, so long as the gas velocity above reduced diameter section 22 is the same as or greater than the gas velocity just above the fresh shale feed point.

The oil shale feed is preferably preheated to about 400° F., which is below the temperature at which any significant pyrolysis occurs, and the recycle spent shale from combustor 20 is preferably at about 1350° F. Sufficient hot recycle shale is mixed with feed shale to provide a mix of about 950° F. in retorting section 24. The use of feed preheat greatly reduces the amount of spent shale needed to provide adequate retorting temperature for the mix, allowing a substantial reduction in retort size compared to processes where the feed is not preheated.

A small amount of fines are carried out of preheater 18 and recovered in separator 26. These recovered fines are combined with the fines from screen 12 and directed to disengaging section 14.

The preheated shale and hot recycle shale flow downwardly through retorting section 24 at a rate such that retorting is substantially complete when the shale exits the vessel. A small amount of product gas is injected into the bottom of retorting section 24 to sweep out retorted products. By maintaining the sweep gas at a low rate, the heaviest kerogen material will tend to stay in the retort where it will crack to produce gas, liquids and coke rather than being swept out with the retort vapors. This additional coke is useful in combustor 20 for heating recycle shale. Also, the gas and liquid products from cracking of the heaviest kerogens are more valuable than the heavy kerogen fraction.

A separator 28 at the top of disengaging section 14 collects and removes fines remaining in the product stream. It may be desirable in some cases to heat a small product gas stream in heat exchanger 30 and heater 33 and inject it into the bottom of disengaging section 14 to control the size of fines which settle in the disengaging section and to prevent condensation of retort products in the disengaging section. Fines from separator 28, which have been substantially retorted in passing upwardly through disengaging section 14, can be combined with fines from combustor 20 which have been separated out at screen 31, and the combined fines can be sent to heat exchanger 32 for heat recovery. The velocity of the gas flowing upwardly in disengaging section 14 should be maintained at or above the velocity just above the fresh shale feed point, but below the rate at which substantial fluidization of solids occurs. Preferably, the superficial gas velocity is above about 100 cm/sec when the fines injected into the disengaging section are minus 4 mesh material. The gas velocity above the fresh shale feed point will determine the size cut point between solids rising through disengaging section 14 and solids falling into retorting section 24.

Retorted shale from the bottom of retorting section 24 is conveyed by bucket elevator 34 or a screw conveyor (not shown) to combustor 20 where carbonaceous material on the incoming shale is burned to provide hot gases for the preheater and hot recycle shale for heating preheated feed to retorting temperature.

Products leaving disengaging section 14 are distilled in atmospheric distillation tower 40. The overheads from tower 40 are cooled and sent to gas separator 36 for recovery of product gas. Liquids from separator 36 and bottoms from tower 40 (through dashed line 41) may be combined directly to provide a snycrude. Preferably, bottoms from atmospheric tower 40 are fed to vacuum distillation tower 42, and vacuum tower overheads are combined with liquids from separator 36 to provide an upgraded syncrude product suitable for refining. The vacuum tower bottoms are recycled back to the hot spent recycle shale line such that the material goes through retorting again and is largely cracked to produce additional gas, liquid and coke.

By distilling the liquid products and removing most of the fines, asphaltenes and contaminating metals from the products, an upgraded syncrude having improved pour point and viscosity characteristics is obtained. This upgraded product is easier to pipeline, and is more acceptable for subsequent refining operations.

The process of this invention provides several advantages over alternative retorting processes. The use of relatively large feed particles minimizes shale crushing costs and reduces the amount of fines generated. The fines that are generated are fed directly to the disengaging section of the retort where the kerogen content thereof is largely recovered, rather than being discarded. Feeding fines to disengaging section 14 and maintaining proper gas velocity eliminates fines disengaging problems in retorting section 24. Fines in the retorting section 24 are minimized by screening hot recycle shale from the combustor. Fines generation in retorting section 24 is minimal because of the minimum attrition flow characteristics therein. The amount of hot recycle shale required to provide retorting heat is reduced by preheating the feed oil shale. The process recovers kerogen from the entire oil shale feed, including the fines, and an upgraded syncrude free of asphaltenes and metals contaminants and having good rheological properties can be produced.

We claim:

1. A process for producing syncrude from oil shale comprising:

(a) providing a particulate oil shale feed comprised of at least 75 percent by weight of plus 4 mesh particles;

(b) separating said oil shale feed into a fines fraction and a crushed shale fraction;

(c) preheating said crushed shale fraction;

(d) feeding said preheated shale fraction to a reduced diameter center section of a retort vessel;

(e) feeding said fines fraction into a disengaging section of said retort vessel, said disengaging section being above said center section and having gas flowing upwardly therein at or above the gas velocity just above the shale feed point, but below the rate at which substantial fluidization of solids occur;

(f) retorting said preheated shale fraction in a gravity flow retorting section of said retort vessel, said retorting section being below said center section and having a larger diameter than said center section;

(g) feeding retorted shale from said retorting section to a combustor to produce hot spent shale and hot combustion gases;

(h) utilizing said hot combustion gases to preheat the crushed shale in preheating step (c);

(i) combining said hot spent shale with said preheated shale fraction being fed to said retort vessel in an amount sufficient to provide retorting heat;

(j) separately recovering retort vapors and separated fines from said disengaging section; and (k) recovering a syncrude from said retort vapors.

2. The process of claim 1 wherein said retort vapors are subjected to atmospheric distillation and vacuum distillation, and the bottoms from said vacuum distillation are combined with at least a part of said hot spent shale which is combined with said preheated shale fraction, and wherein overheads from said atmospheric distillation are cooled and sent to a gas separation step, and a first part of the product gas from said gas separation step is injected into the lower part of said retorting section at a rate sufficient to sweep out retorted vapors.

3. The process of claim 2 wherein a second part of the gas from said gas separation step is heated and injected into the lower part of said disengaging section.

* * * * *